US007299174B2

(12) United States Patent
Sato et al.

(10) Patent No.: US 7,299,174 B2
(45) Date of Patent: Nov. 20, 2007

(54) SPEECH CODING APPARATUS INCLUDING ENHANCEMENT LAYER PERFORMING LONG TERM PREDICTION

(75) Inventors: Kaoru Sato, Yokohama (JP); Toshiyuki Morii, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/554,619

(22) PCT Filed: Apr. 30, 2004

(86) PCT No.: PCT/JP2004/006294

§ 371 (c)(1),
(2), (4) Date: Mar. 27, 2006

(87) PCT Pub. No.: WO2004/097796

PCT Pub. Date: Nov. 11, 2004

(65) Prior Publication Data

US 2006/0173677 A1 Aug. 3, 2006

(30) Foreign Application Priority Data

Apr. 30, 2003 (JP) ..... 2003-125665

(51) Int. Cl.
*G10L 19/04* (2006.01)
*G10L 19/12* (2006.01)

(52) U.S. Cl. ..... 704/219; 704/223

(58) Field of Classification Search ..... 704/219, 704/201, 223

See application file for complete search history.

(56) References Cited

U.S. PATENT DOCUMENTS

| | | | | |
|---|---|---|---|---|
| 5,671,327 | A | 9/1997 | Akamine et al. | |
| 5,781,880 | A | 7/1998 | Su | |
| 5,797,118 | A | 8/1998 | Saito | |
| 5,864,797 | A | 1/1999 | Fujimoto | |
| 6,208,957 | B1 * | 3/2001 | Nomura | 704/207 |
| 6,735,567 | B2 * | 5/2004 | Gao et al. | 704/258 |
| 6,856,961 | B2 * | 2/2005 | Thyssen | 704/500 |
| 7,020,605 | B2 * | 3/2006 | Gao | 704/225 |
| 2005/0171771 | A1 | 8/2005 | Yasunaga et al. | |
| 2005/0197833 | A1 | 9/2005 | Yasunaga et al. | |

OTHER PUBLICATIONS

English Language Abstract of JP 8-054900.

(Continued)

*Primary Examiner*—Talivaldis Ivars Smits
*Assistant Examiner*—Thomas E. Shortledge
(74) *Attorney, Agent, or Firm*—Greenblum & Bernstein, P.L.C.

(57) ABSTRACT

To implement scalable coding, a base layer coding section encodes an input signal to obtain base layer coded information, which is decoded by a base layer decoding section to obtain a base layer decoded signal and long term prediction information (pitch lag). An adding section inverts the polarity of the base layer decoded signal to add to the input signal, and obtains a residual signal. An enhancement layer coding section encodes a long term prediction coefficient calculated using the long term prediction information and the residual signal to obtain enhancement layer coded information. Also using the long term prediction information, an enhancement layer decoding section decodes the enhancement layer coded information to obtain an enhancement layer decoded signal. An adding section adds the base layer decoded signal and enhancement layer decoded signal to obtain a speech/sound signal.

6 Claims, 9 Drawing Sheets

OTHER PUBLICATIONS

English Language Abstract of JP 8-328595.
English Language Abstract of JP 10-177399.
English Language Abstract of JP 5-249999.
English Language Abstract of JP 8-147000.
English Language Abstract of JP 8-211895.
English Language Abstract of JP 5-073099.
English Language Abstract of JP 6-102900.

* cited by examiner

SPEECH CODING APPARATUS INCLUDING ENHANCEMENT LAYER PERFORMING LONG TERM PREDICTION

TECHNICAL FIELD

The present invention relates to a speech coding apparatus, speech decoding apparatus and methods thereof used in communication systems for coding and transmitting speech and/or sound signals.

BACKGROUND ART

In the fields of digital wireless communications, packet communications typified by Internet communications, and speech storage and so forth, techniques for coding/decoding speech signals are indispensable in order to efficiently use the transmission channel capacity of radio signal and storage medium, and many speech coding/decoding schemes have been developed. Among the systems, the CELP speech coding/decoding scheme has been put into practical use as a mainstream technique.

A CELP type speech coding apparatus encodes input speech based on speech models stored beforehand. More specifically, the CELP speech coding apparatus divides a digitalized speech signal into frames of about 20 ms, performs linear prediction analysis of the speech signal on a frame-by-frame basis, obtains linear prediction coefficients and linear prediction residual vector, and encodes separately the linear prediction coefficients and linear prediction residual vector.

In order to execute low-bit rate communications, since the amount of speech models to be stored is limited, phonation speech models are chiefly stored in the conventional CELP type speech coding/decoding scheme.

In communication systems for transmitting packets such as Internet communications, packet losses occur depending on the state of the network, and it is preferable that speech and sound can be decoded from part of remaining coded information even when part of the coded information is lost. Similarly, in variable rate communication systems for varying the bit rate according to the communication capacity, when the communication capacity is decreased, it is desired that loads on the communication capacity can be reduced at ease by transmitting only part of the coded information. Thus, as a technique enabling decoding of speech and sound using all the coded information or part of the coded information, attention has recently been directed toward the scalable coding technique. Some scalable coding schemes are disclosed conventionally.

The scalable coding system is generally comprised of a base layer and enhancement layer, and the layers constitute a hierarchical structure with the base layer being the lowest layer. In each layer, a residual signal is coded that is a difference between an input signal and output signal in a lower layer. According to this constitution, it is possible to decode speech and/or sound signals using the coded information of all the layers or using only the coded information of a lower layer.

However, in the conventional scalable coding system, the CELP type speech coding/decoding system is used as the coding schemes for the base layer and enhancement layers, and considerable amounts are thereby required both in calculation and coded information.

DISCLOSURE OF INVENTION

It is therefore an object of the present invention to provide a speech coding apparatus, speech decoding apparatus and methods thereof enabling scalable coding to be implemented with small amounts of calculation and coded information.

The above-noted object is achieved by providing an enhancement layer to perform long term prediction, performing long term prediction of the residual signal in the enhancement layer using a long term correlation characteristic of speech or sound to improve the quality of the decoded signal, obtaining a long term prediction lag using long term prediction information of a base layer, and thereby reducing the computation amount.

BEST MODE FOR CARRYING OUT THE INVENTION

Embodiments of the present invention will specifically be described below with reference to the accompanying drawings. A case will be described in each of the Embodiments where long term prediction is performed in an enhancement layer in a two layer speech coding/decoding method comprised of a base layer and the enhancement layer. However, the invention is not limited in layer structure, and applicable to any cases of performing long term prediction in an upper layer using long term prediction information of a lower layer in a hierarchical speech coding/decoding method with three or more layers. A hierarchical speech coding method refers to a method in which a plurality of speech coding methods for coding a residual signal (difference between an input signal of a lower layer and a decoded signal of the lower layer) by long term prediction to output coded information exist in upper layers and constitute a hierarchical structure. Further, a hierarchical speech decoding method refers to a method in which a plurality of speech decoding methods for decoding a residual signal exists in an upper layer and constitutes a hierarchical structure. Herein, a speech/sound coding/decoding method existing in the lowest layer will be referred to as a base layer. A speech/sound coding/decoding method existing in a layer higher than the base layer will be referred to as an enhancement layer.

In each of the Embodiments of the invention, a case is described as an example where the base layer performs CELP type speech coding/decoding.

Embodiment 1

Figure 1:
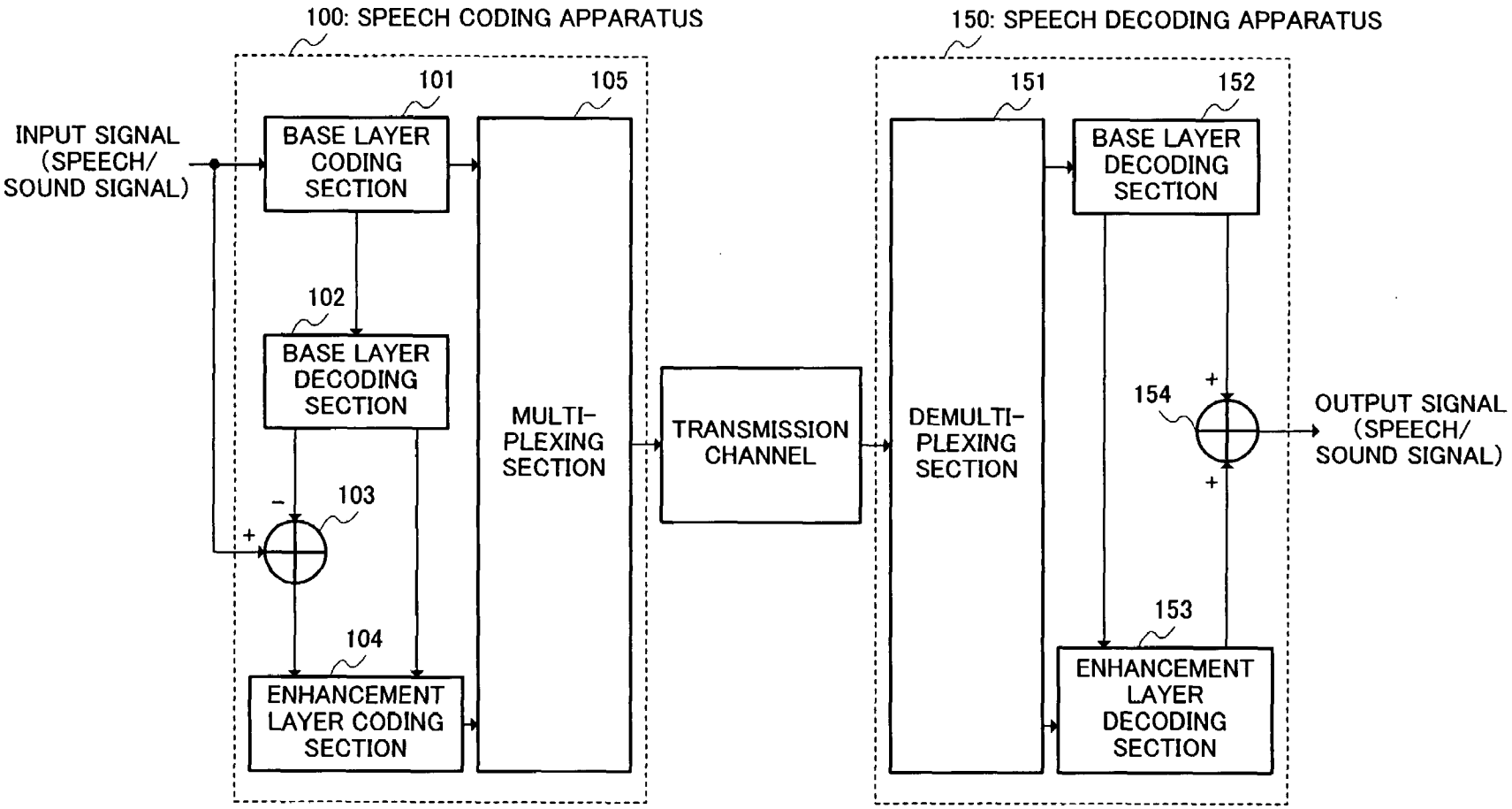
FIG. 1 is a block diagram illustrating configurations of a speech coding apparatus and speech decoding apparatus according to Embodiment 1 of the invention.

FIG. 1 is a block diagram illustrating configurations of a speech coding apparatus and speech decoding apparatus according to Embodiment 1 of the invention.

In FIG. 1, speech coding apparatus 100 is mainly comprised of base layer coding section 101, base layer decoding section 102, adding section 103, enhancement layer coding section 104, and multiplexing section 105. Speech decoding apparatus 150 is mainly comprised of demultiplexing section 151, base layer decoding section 152, enhancement layer decoding section 153, and adding section 154.

Base layer coding section 101 receives a speech or sound signal, codes the input signal using the CELP type speech coding method, and outputs base layer coded information obtained by the coding, to base layer decoding section 102 and multiplexing section 105.

Base layer decoding section 102 decodes the base layer coded information using the CELP type speech decoding method, and outputs a base layer decoded signal obtained by the decoding, to adding section 103. Further, base layer decoding section 102 outputs the pitch lag to enhancement layer coding section 104 as long term prediction information of the base layer.

The "long term prediction information" is information indicating long term correlation of the speech or sound signal. The "pitch lag" refers to position information specified by the base layer, and will be described later in detail.

Adding section 103 inverts the polarity of the base layer decoded signal output from base layer decoding section 102 to add to the input signal, and outputs a residual signal as a result of the addition to enhancement layer coding section 104.

Enhancement layer coding section 104 calculates long term prediction coefficients using the long term prediction information output from base layer decoding section 102 and the residual signal output from adding section 103, codes the long term prediction coefficients, and outputs enhancement layer coded information obtained by coding to multiplexing section 105.

Multiplexing section 105 multiplexes the base layer coded information output from base layer coding section 101 and the enhancement layer coded information output from enhancement layer coding section 104 to output to demultiplexing section 151 as multiplexed information via a transmission channel.

Demultiplexing section 151 demultiplexes the multiplexed information transmitted from speech coding apparatus 100 into the base layer coded information and enhancement layer coded information, and outputs the demultiplexed base layer coded information to base layer decoding section 152, while outputting the demultiplexed enhancement layer coded information to enhancement layer decoding section 153.

Base layer decoding section 152 decodes the base layer coded information using the CELP type speech decoding method, and outputs a base layer decoded signal obtained by the decoding, to adding section 154. Further, base layer decoding section 152 outputs the pitch lag to enhancement layer decoding section 153 as the long term prediction information of the base layer. Enhancement layer decoding section 153 decodes the enhancement layer coded information using the long term prediction information, and outputs an enhancement layer decoded signal obtained by the decoding, to adding section 154.

Adding section 154 adds the base layer decoded signal output from base layer decoding section 152 and the enhancement layer decoded signal output from enhancement layer decoding section 153, and outputs a speech or sound signal as a result of the addition, to an apparatus for subsequent processing.

Figure 2:
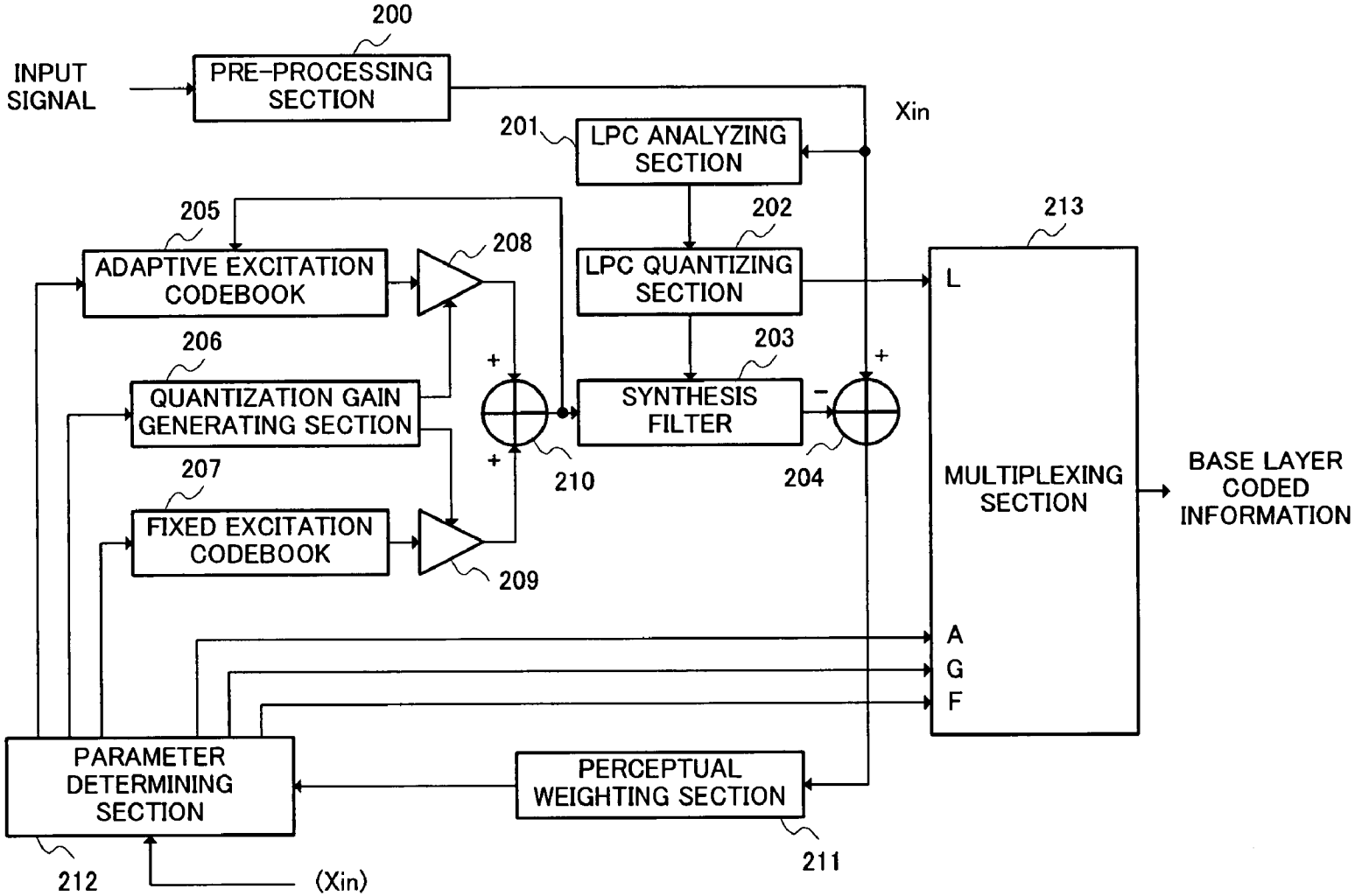
FIG. 2 is a block diagram illustrating an internal configuration a base layer coding section according to the above Embodiment.

The internal configuration of base layer coding section 101 of FIG. 1 will be described below with reference to the block diagram of FIG. 2.

An input signal of base layer coding section 101 is input to pre-processing section 200. Pre-processing section 200 performs high-pass filtering processing to remove the DC component, waveform shaping processing and pre-emphasis processing to improve performance of subsequent coding processing, and outputs a signal (Xin) subjected to the processing, to LPC analyzing section 201 and adder 204.

LPC analyzing section 201 performs linear predictive analysis using Xin, and outputs a result of the analysis (linear prediction coefficients) to LPC quantizing section 202. LPC quantizing section 202 performs quantization processing on the linear prediction coefficients (LPC) output from LPC analyzing section 201, and outputs quantized LPC to synthesis filter 203, while outputting code (L) representing the quantized LPC, to multiplexing section 213.

Synthesis filter 203 generates a synthesized signal by performing filter synthesis on an excitation vector output from adding section 210 described later using filter coefficients based on the quantized LPC, and outputs the synthesized signal to adder 204.

Adder 204 inverts the polarity of the synthesized signal, adds the resulting signal to Xin, calculates an error signal, and outputs the error signal to perceptual weighting section 211.

Adaptive excitation codebook 205 has excitation vector signals output earlier from adder 210 stored in a buffer, and fetches a sample corresponding to one frame from an earlier excitation vector signal sample specified by a signal output from parameter determining section 212 to output to multiplier 208.

Quantization gain generating section 206 outputs an adaptive excitation gain and fixed excitation gain specified by a signal output from parameter determining section 212 respectively to multipliers 208 and 209.

Fixed excitation codebook 207 multiplies a pulse excitation vector having a shape specified by the signal output from parameter determining section 212 by a spread vector, and outputs the obtained fixed excitation vector to multiplier 209.

Multiplier 208 multiplies the quantization adaptive excitation gain output from quantization gain generating section 206 by the adaptive excitation vector output from adaptive excitation codebook 205 and outputs the result to adder 210. Multiplier 209 multiplies the quantization fixed excitation gain output from quantization gain generating section 206 by the fixed excitation vector output from fixed excitation codebook 207 and outputs the result to adder 210.

Adder 210 receives the adaptive excitation vector and fixed excitation vector both multiplied by the gain respectively input from multipliers 208 and 209 to add in vector, and outputs an excitation vector as a result of the addition to synthesis filter 203 and adaptive excitation codebook 205. In addition, the excitation vector input to adaptive excitation codebook 205 is stored in the buffer.

Perceptual weighting section 211 performs perceptual weighting on the error signal output from adder 204, and calculates a distortion between Xin and the synthesized signal in a perceptual weighting region and outputs the result to parameter determining section 212.

Parameter determining section 212 selects the adaptive excitation vector, fixed excitation vector and quantization gain that minimize the coding distortion output from perceptual weighting section 211 respectively from adaptive excitation codebook 205, fixed excitation codebook 207 and quantization gain generating section 206, and outputs adaptive excitation vector code (A), excitation gain code (G) and fixed excitation vector code (F) representing the result of the selection to multiplexing section 213. In addition, the adaptive excitation vector code (A) is code corresponding to the pitch lag.

Multiplexing section 213 receives the code (L) representing quantized LPC from LPC quantizing section 202, further receives the code (A) representing the adaptive excitation vector, the code (F) representing the fixed excitation vector and the code (G) representing the quantization gain from parameter determining section 212, and multiplexes these pieces of information to output as base layer coded information.

The foregoing is explanations of the internal configuration of base layer coding section 101 of FIG. 1.

Figure 3:
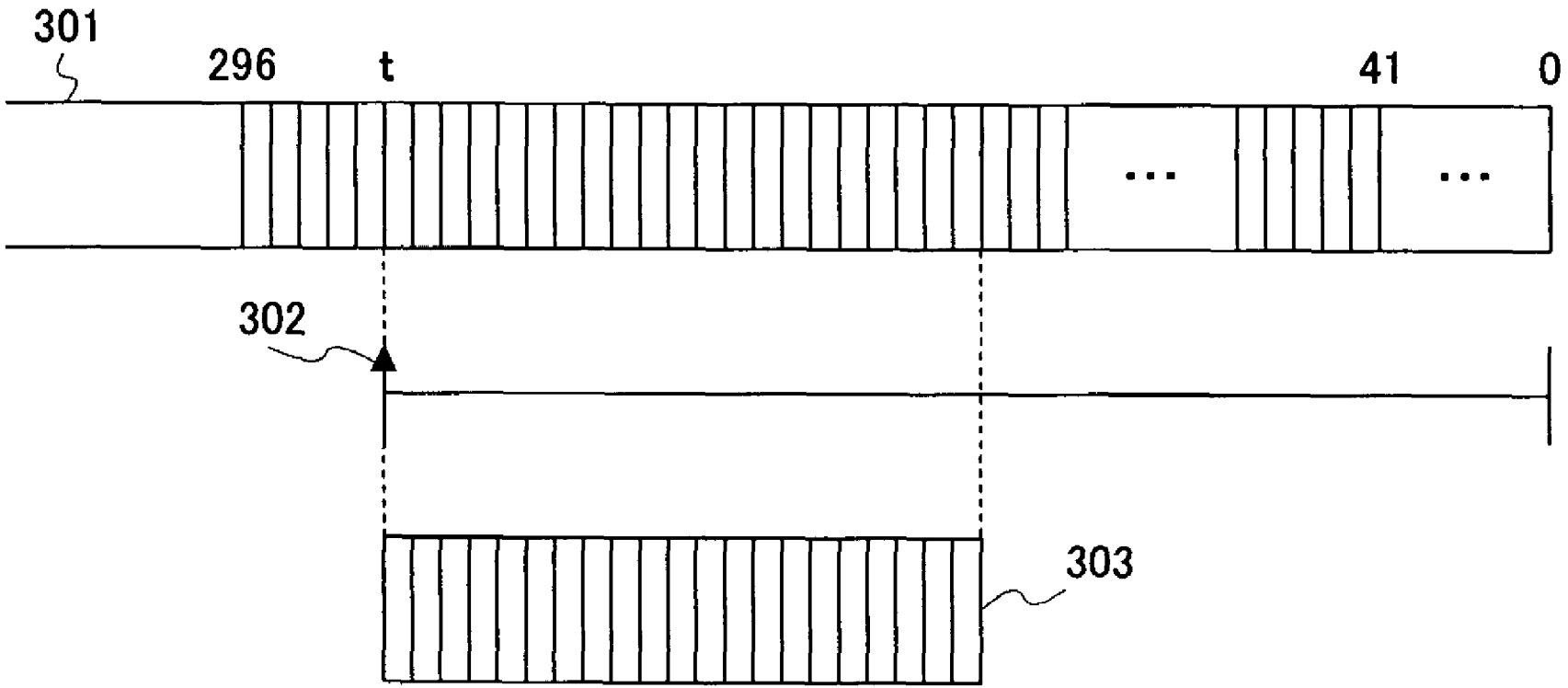
FIG. 3 is a diagram to explain processing for a parameter determining section in the base layer coding section to determine a signal generated from an adaptive excitation codebook according to the above Embodiment.

With reference to FIG. 3, the processing will briefly be described below for parameter determining section 212 to determine a signal to be generated from adaptive excitation codebook 205. In FIG. 3, buffer 301 is the buffer provided in adaptive excitation codebook 205, position 302 is a fetching position for the adaptive excitation vector, and vector 303 is a fetched adaptive excitation vector. Numeric values "41" and "296" respectively correspond to the lower limit and the upper limit of a range in which fetching position 302 is moved.

The range for moving fetching position 302 is set at a range with a length of "256" (for example, from "41" to "296"), assuming that the number of bits assigned to the code (A) representing the adaptive excitation vector is "8." The range for moving fetching position 302 can be set arbitrarily.

Parameter determining section 212 moves fetching position 302 in the set range, and fetches adaptive excitation vector 303 by the frame length from each position. Then, parameter determining section 212 obtains fetching position 302 that minimizes the coding distortion output from perceptual weighting section 211.

Fetching position 302 in the buffer thus obtained by parameter determining section 212 is the "pitch lag".

The internal configuration of base layer decoding section 102 (152) of FIG. 1 will be described below with reference to FIG. 4.

Figure 4:
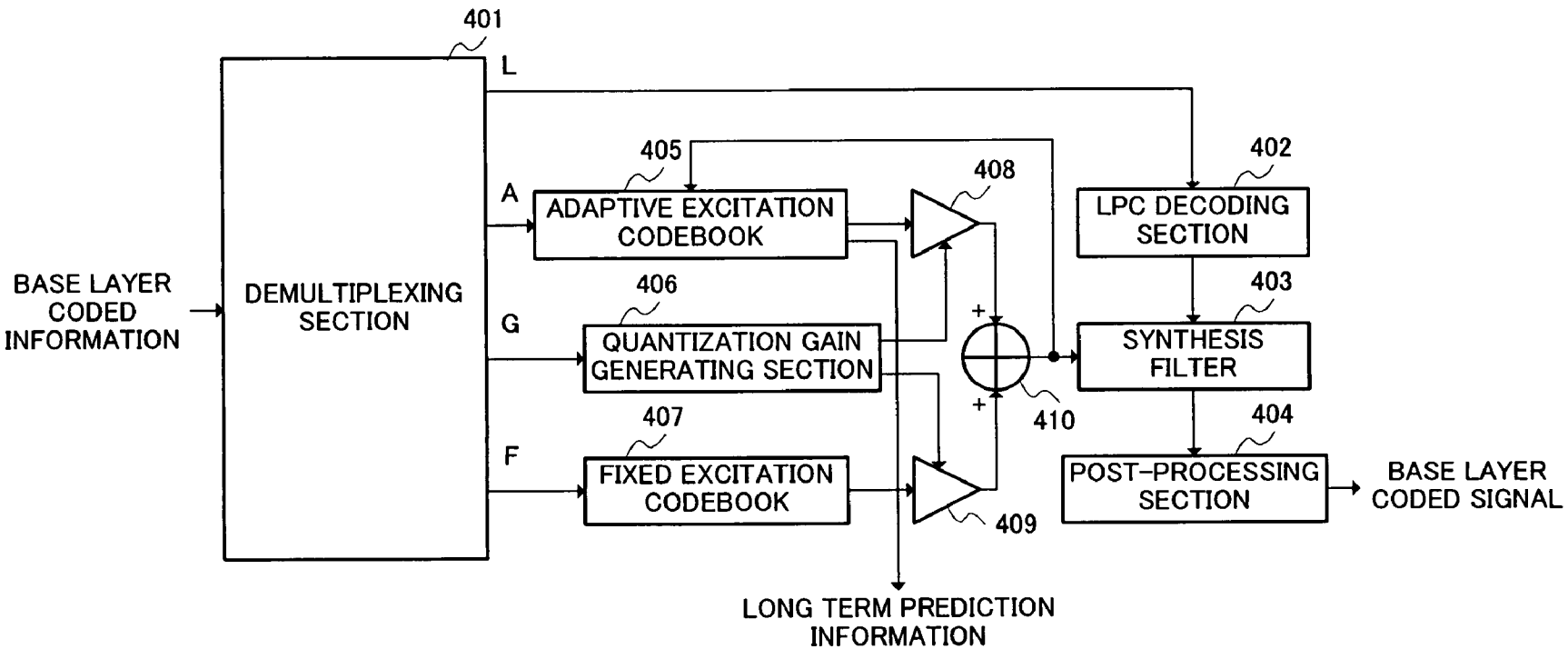
FIG. 4 is a block diagram illustrating an internal configuration of a base layer decoding section according to the above Embodiment.

In FIG. 4, the base layer coded information input to base layer decoding section 102 (152) is demultiplexed to separate codes (L, A, G and F) by demultiplexing section 401. The demultiplexed LPC code (L) is output to LPC decoding section 402, the demultiplexed adaptive excitation vector code (A) is output to adaptive excitation codebook 405, the demultiplexed excitation gain code (G) is output to quantization gain generating section 406, and the demultiplexed fixed excitation vector code (F) is output to fixed excitation codebook 407.

LPC decoding section 402 decodes the LPC from the code (L) output from demultiplexing section 401 and outputs the result to synthesis filter 403.

Adaptive excitation codebook 405 fetches a sample corresponding to one frame from a past excitation vector signal sample designated by the code (A) output from demultiplexing section 401 as an excitation vector and outputs the excitation vector to multiplier 408. Further, adaptive excitation codebook 405 outputs the pitch lag as the long term prediction information to enhancement layer coding section 104 (enhancement layer decoding section 153).

Quantization gain generating section 406 decodes an adaptive excitation vector gain and fixed excitation vector gain designated by the excitation gain code (G) output from demultiplexing section 401 respectively and output the results to multipliers 408 and 409.

Fixed excitation codebook 407 generates a fixed excitation vector designated by the code (F) output from demultiplexing section 401 and outputs the result to adder 409.

Multiplier 408 multiplies the adaptive excitation vector by the adaptive excitation vector gain and outputs the result to adder 410. Multiplier 409 multiplies the fixed excitation vector by the fixed excitation vector gain and outputs the result to adder 410.

Adder 410 adds the adaptive excitation vector and fixed excitation vector both multiplied by the gain respectively output from multipliers 408 and 409, generates an excitation vector, and outputs this excitation vector to synthesis filter 403 and adaptive excitation codebook 405.

Synthesis filter 403 performs filter synthesis using the excitation vector output from adder 410 as an excitation signal and further using the filter coefficients decoded in LPC decoding section 402, and outputs a synthesized signal to post-processing section 404.

Post-processing section 404 performs on the signal output from synthesis filter 403 processing for improving subjective quality of speech such as formant emphasis and pitch emphasis and other processing for improving subjective quality of stationary noise to output as a base layer decoded signal.

The foregoing is explanations of the internal configuration of base layer decoding section 102 (152) of FIG. 1.

The internal configuration of enhancement layer coding section 104 of FIG. 1 will be described below with reference to FIG. 5.

Enhancement layer coding section 104 divides the residual signal into segments of N samples (N is a natural number), and performs coding for each frame assuming N samples as one frame. Hereinafter, the residual signal is represented by e(0)~e(X−1), and frames subject to coding is represented by e(n)~e(n+N−1). Herein, X is a length of the residual signal, and N corresponds to the length of the frame. n is a sample positioned at the beginning of each frame, and corresponds to an integral multiple of N. In addition, the method of predicting a signal of some frame from previously generated signals is called long term prediction. A filter for performing long term prediction is called pitch filter, comb filter and the like.

Figure 5:
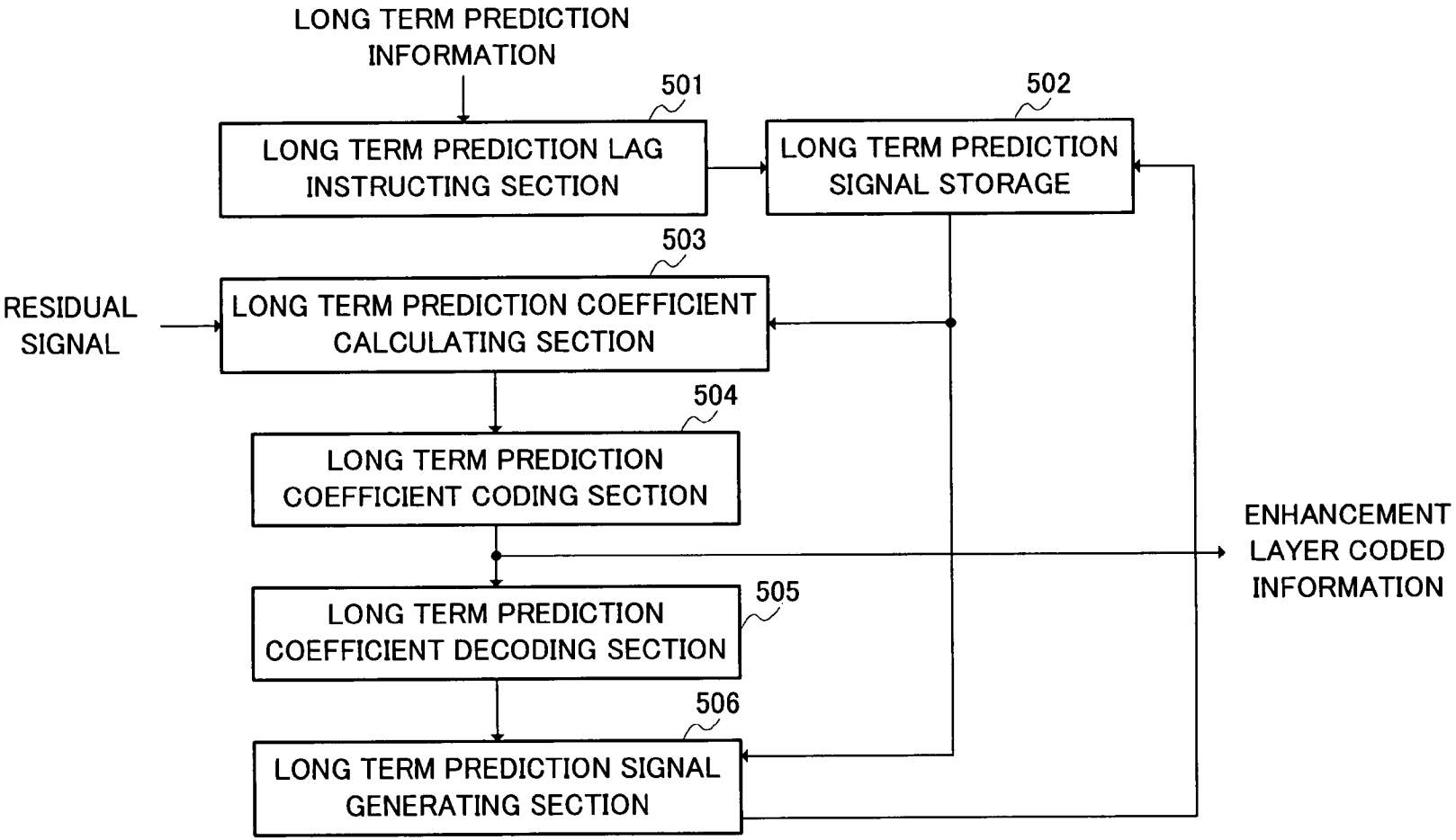
FIG. 5 is a block diagram illustrating an internal configuration of an enhancement layer coding section according to the above Embodiment.

In FIG. 5, long term prediction lag instructing section 501 receives long term prediction information t obtained in base layer decoding section 102, and based on the information, obtains long term prediction lag T of the enhancement layer to output to long term prediction signal storage 502. In addition, when a difference in sampling frequency occurs between the base layer and enhancement layer, the long term prediction lag T is obtained from following equation (1). In addition, in equation (1), D is the sampling frequency of the enhancement layer, and d is the sampling frequency of the base layer.

$$T=D\times t/d \qquad \text{Equation.(1)}$$

Long term prediction signal storage 502 is provided with a buffer for storing a long term prediction signal generated earlier. When the length of the buffer is assumed M, the buffer is comprised of sequence s(n−M−1)~s(n−1) of the previously generated long term prediction signal. Upon receiving the long term prediction lag T from long term prediction lag instructing section 501, long term prediction signal storage 502 fetches long term prediction signal s(n−T)~s(n−T+N−1) the long term prediction lag T back from the previous long term prediction signal sequence stored in the buffer, and outputs the result to long term prediction coefficient calculating section 503 and long term prediction signal generating section 506. Further, long term prediction signal storage 502 receives long term prediction signal s(n)~s(n+N−1) from long term prediction signal generating section 506, and updates the buffer by following equation (2).

$$\hat{s}(i)=s(i+N)(i=n-M-1, \ldots, n-1)$$

$$s(i)=\hat{s}(i)(i=n-M-1, \ldots, n-1) \qquad \text{Equation (2)}$$

In addition, when the long term prediction lag T is shorter than the frame length N and long term prediction signal storage 502 cannot fetch a long term prediction signal, the long term prediction lag T is multiplied by integrals until the T is longer than the frame length N, to enable the long term prediction signal to be fetched. Otherwise, long term prediction signal s(n−T)~s(n−T+N−1) the long term prediction lag T back is repeated up to the frame length N to be fetched.

Long term prediction coefficient calculating section 503 receives the residual signal e(n)~e(n+N−1) and long term prediction signal s(n−T)~s(n−T+N−1), and using these signals in following equation (3), calculates a long term prediction coefficient β to output to long term prediction coefficient coding section 504.

$$\beta=\frac{\sum_{i=0}^{N-1} e(n+i)s(n-T+i)}{\sum_{i=0}^{N-1} s(n-T+i)^2} \qquad \text{Equation (3)}$$

Long term prediction coefficient coding section 504 codes the long term prediction coefficient β, and outputs the enhancement layer coded information obtained by coding to long term prediction coefficient decoding section 505, while further outputting the information to enhancement layer decoding section 153 via the transmission channel. In addition, as a method of coding the long term prediction coefficient β, there are known a method by scalar quantization and the like.

Long term prediction coefficient decoding section 505 decodes the enhancement layer coded information, and outputs a decoded long term prediction coefficient βq obtained by decoding to long term prediction signal generating section 506.

Long term prediction signal generating section 506 receives as input the decoded long term prediction coefficient βq and long term prediction signal s(n−T) ~s(n−T+N−1), and, using the input, calculates long term prediction signal s(n)~s(n+N−1) by following equation (4), and outputs the result to long term prediction signal storage 502.

$$s(n+i)=\beta_q\times s(n-T+1)(i=0, \ldots, N-1) \qquad \text{Equation (4)}$$

The foregoing is explanations of the internal configuration of enhancement layer coding section 104 of FIG. 1.

The internal configuration of enhancement layer decoding section 153 of FIG. 1 will be described below with reference to the block diagram of FIG. 6.

Figure 6:
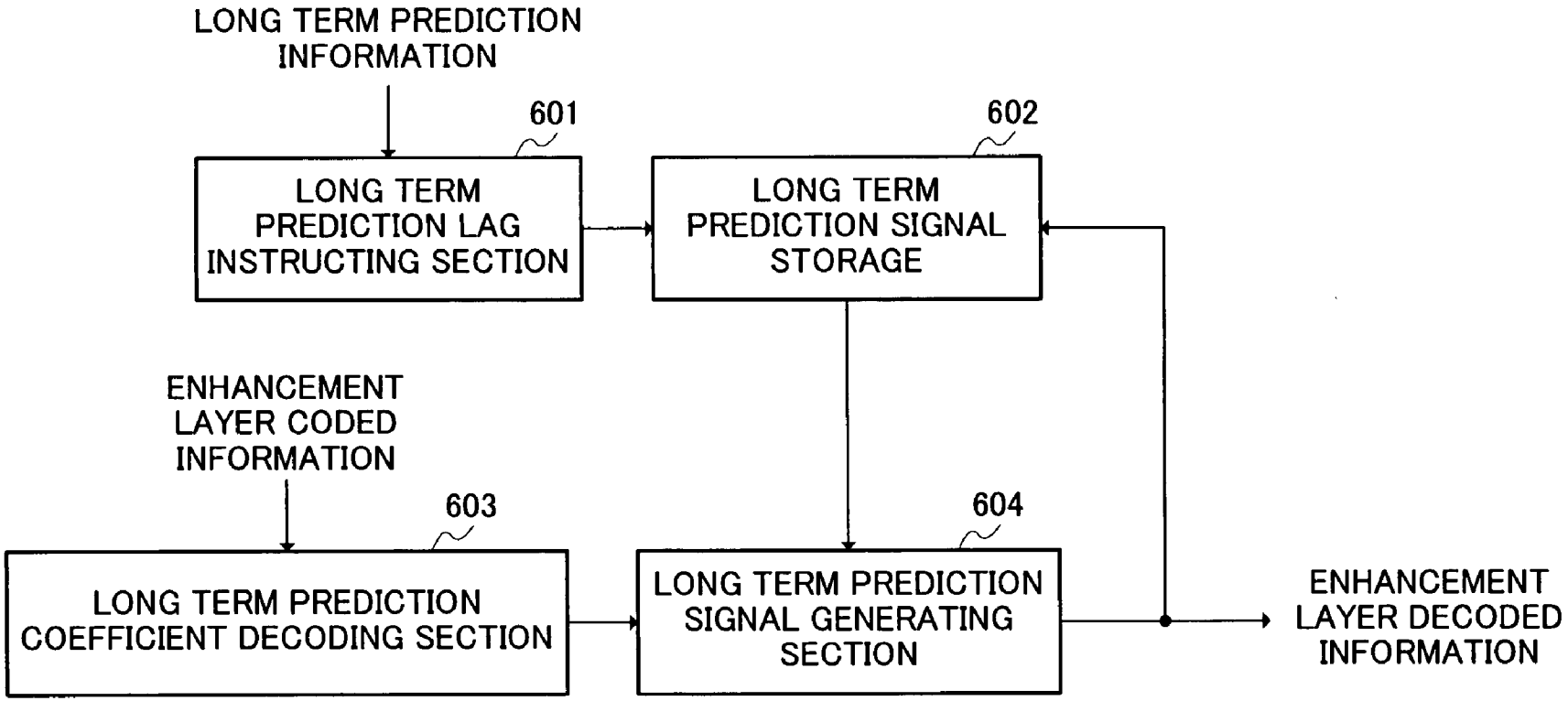
FIG. 6 is a block diagram illustrating an internal configuration of an enhancement layer decoding section according to the above Embodiment.

In FIG. 6, long term prediction lag instructing section 601 obtains the long term prediction lag T of the enhancement layer using the long term prediction information output from base layer decoding section 152 to output to long term prediction signal storage 602.

Long term prediction signal storage 602 is provided with a buffer for storing a long term prediction signal generated earlier. When the length of the buffer is M, the buffer is comprised of sequence s(n−M−1)~s(n−1) of the earlier generated long term prediction signal. Upon receiving the long term prediction lag T from long term prediction lag instructing section 601, long term prediction signal storage 602 fetches long term prediction signal s(n−T)~s(n−T+N−1) the long term prediction lag T back from the previous long term prediction signal sequence stored in the buffer to output to long term prediction signal generating section 604. Further, long term prediction signal storage 602 receives long term prediction signals s(n)~s(n+N−1) from long term prediction signal generating section 604, and updates the buffer by equation (2) as described above.

Long term prediction coefficient decoding section 603 decodes the enhancement layer coded information, and outputs the decoded long term prediction coefficient βq obtained by the decoding, to long term prediction signal generating section 604.

Long term prediction signal generating section 604 receives as its inputs the decoded long term prediction coefficient βq and long term prediction signal s(n−T) ~s(n−T+N−1), and using the inputs, calculates long term prediction signal s(n)~s(n+N−1) by Eq. (4) as described above, and outputs the result to long term prediction signal storage 602 and adding section 153 as an enhancement layer decoded signal.

The foregoing is explanations of the internal configuration of enhancement layer decoding section 153 of FIG. 1.

Thus, by providing the enhancement layer to perform long term prediction and performing long term prediction on the residual signal in the enhancement layer using the long term correlation characteristic of the speech or sound signal, it is possible to code/decode the speech/sound signal with a wide frequency range using less coded information and to reduce the computation amount.

At this point, the coded information can be reduced by obtaining the long term prediction lag using the long term prediction information of the base layer, instead of coding/decoding the long term prediction lag.

Further, by decoding the base layer coded information, it is possible to obtain only the decoded signal of the base layer, and implement the function for decoding the speech or sound from part of the coded information in the CELP type speech coding/decoding method (scalable coding).

Furthermore, in the long term prediction, using the long term correlation of the speech or sound, a frame with the highest correlation with the current frame is fetched from the buffer, and using a signal of the fetched frame, a signal of the current frame is expressed. However, in the means for fetching the frame with the highest correlation with the current frame from the buffer, when there is no information to represent the long term correlation of speech or sound such as the pitch lag, it is necessary to vary the fetching position to fetch a frame from the buffer while calculating the auto-correlation function of the fetched frame and the current frame to search for the frame with the highest correlation, and the calculation amount for the search becomes significantly large.

However, by determining the fetching position uniquely using the pitch lag obtained in base layer coding section 101, it is possible to largely reduce the calculation amount required for general long term prediction.

In addition, a case has been described above in the enhancement layer long term prediction method explained in this Embodiment where the long term prediction information output from the base layer decoding section is the pitch lag, but the invention is not limited to this, and any information may be used as the long term prediction information as long as the information represents the long term correlation of speech or sound.

Further, the case is described in this Embodiment where the position for long term prediction signal storage 502 to fetch a long term prediction signal from the buffer is the long term prediction lag T, but the invention is applicable to a case where such a position is position T+α (α is a minute number and settable arbitrarily) around the long term prediction lag T, and it is possible to obtain the same effects and advantages as in this Embodiment even in the case where a minute error occurs in the long term prediction lag T.

For example, long term prediction signal storage 502 receives the long term prediction lag T from long term prediction lag instructing section 501, fetches long term prediction signal s(n−T−α)~s(n−T−α+N−1) T+α back from the previous long term prediction signal sequence stored in the buffer, calculates a determination value C using following equation (5), and obtains a that maximizes the determination value C, and encodes this. Further, in the case of decoding, long term prediction signal storage 602 decodes the coded information of α, and using the long term prediction lag T, fetches long term prediction signal s(n−T−α)~s(n−T−α+N−1).

$$C = \frac{\left[\sum_{i=0}^{N-1} e(n+i)s(n-T-\alpha+i)\right]^2}{\sum_{i=0}^{N-1} s(n-T-\alpha+i)^2} \qquad \text{Equation (5)}$$

Further, while a case has been described above in this Embodiment where long term prediction is carried out using a speech/sound signal, the invention is eventually applicable to a case of transforming a speech/sound signal from the time domain to the frequency domain using orthogonal transform such as MDCT and QMF, and performing long term prediction using a transformed signal (frequency parameter), and it is still possible to obtain the same effects and advantages as in this Embodiment. For example, in the case of performing enhancement layer long term prediction using the frequency parameter of a speech/sound signal, in FIG. 5, long term prediction coefficient calculating section 503 is newly provided with a function of transforming long term prediction signal s(n−T)~s(n−T+N−1) from the time domain to the frequency domain and with another function of transforming a residual signal to the frequency parameter, and long term prediction signal generating section 506 is newly provided with a function of inverse-transforming long term prediction signals s(n) ~s(n+N−1) from the frequency domain to time domain. Further, in FIG. 6, long term prediction signal generating section 604 is newly provided with the function of inverse-transforming long term prediction signal s(n)~s(n+N−1) from the frequency domain to the time domain.

It is general in the general speech/sound coding/decoding method adding redundant bits for use in error detection or error correction to the coded information and transmitting the coded information containing the redundant bits on the transmission channel. It is possible in the invention to weight a bit assignment of redundant bits assigned to the coded information (A) output from base layer coding section 101 and to the coded information (B) output from enhancement layer coding section 104 to the coded information (A) to assign.

Embodiment 2

Embodiment 2 will be described with reference to a case of coding and decoding a difference (long term prediction residual signal) between the residual signal and long term prediction signal.

Configurations of a speech coding apparatus and speech decoding apparatus of this Embodiment are the same as those in FIG. 1 except for the internal configurations of enhancement layer coding section 104 and enhancement layer decoding section 153.

Figure 7:
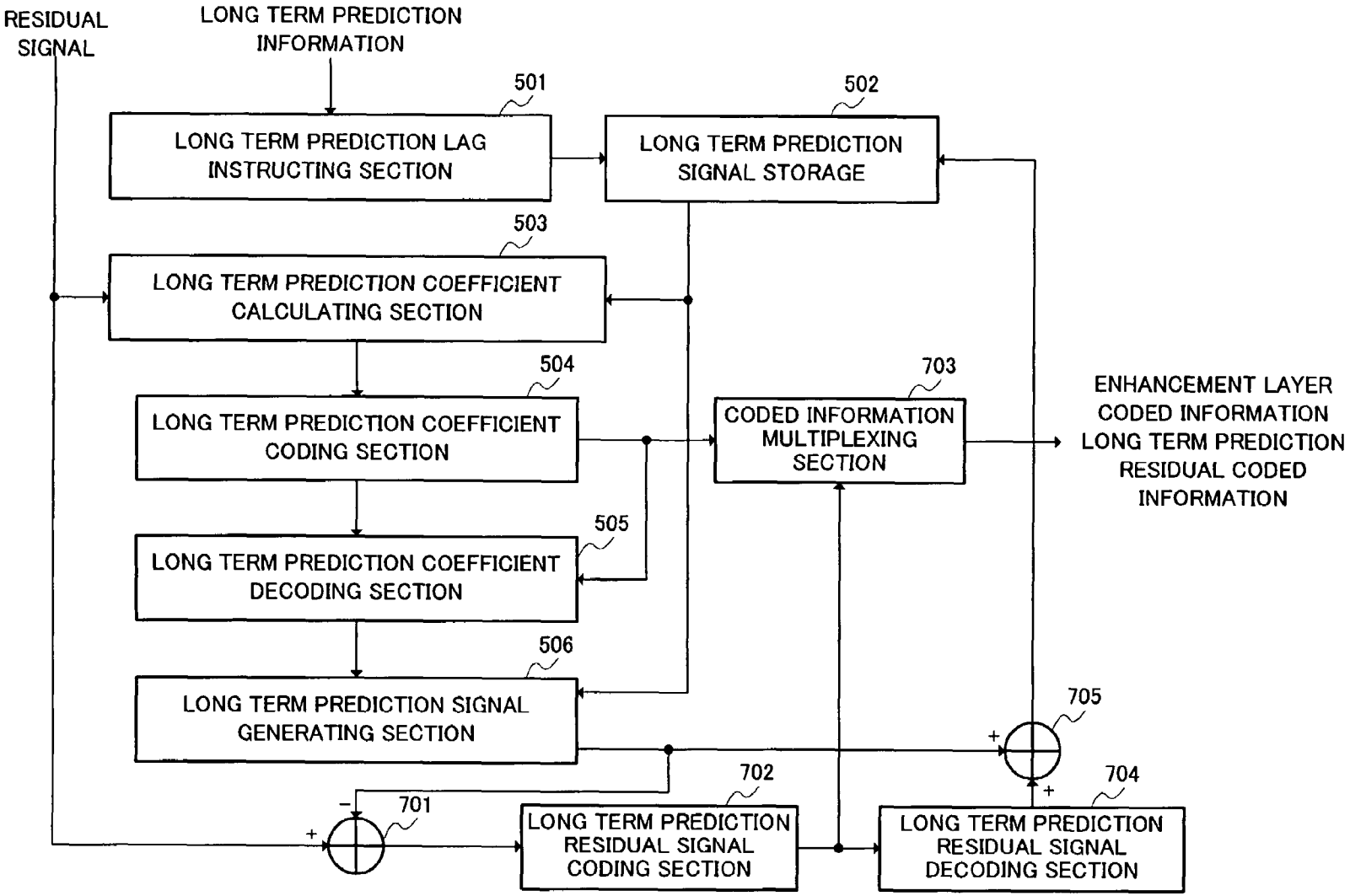
FIG. 7 is a block diagram illustrating an internal configuration of an enhancement layer coding section according to Embodiment 2 of the invention.

FIG. 7 is a block diagram illustrating an internal configuration of enhancement layer coding section 104 according to this Embodiment. In addition, in FIG. 7, structural elements common to FIG. 5 are assigned the same reference numerals as in FIG. 5 to omit descriptions.

As compared with FIG. 5, enhancement layer coding section 104 in FIG. 7 is further provided with adding section 701, long term prediction residual signal coding section 702, coded information multiplexing section 703, long term prediction residual signal decoding section 704 and adding section 705.

Long term prediction signal generating section 506 outputs calculated long term prediction signal s(n)~s(n+N−1) to adding sections 701 and 702.

As expressed in following equation (6), adding section 701 inverts the polarity of long term prediction signal s(n)~s(n+N−1), adds the result to residual signal e(n)~e(n+N−1), and outputs long term prediction residual signal p(n)~p(n+N−1) as a result of the addition to long term prediction residual signal coding section 702.

$$p(n+i)=e(n+i)-s(n+i)(i=0, \ldots, N-1) \qquad \text{Equation (6)}$$

Long term prediction residual signal coding section 702 codes long term prediction residual signal p(n)~p(n+N−1), and outputs coded information (hereinafter, referred to as "long term prediction residual coded information") obtained by coding to coded information multiplexing section 703 and long term prediction residual signal decoding section 704.

In addition, the coding of the long term prediction residual signal is generally performed by vector quantization.

A method of coding long term prediction residual signal p(n)~p(n+N−1) will be described below using as one example a case of performing vector quantization with 8 bits. In this case, a codebook storing beforehand generated 256 types of code vectors is prepared in long term prediction residual signal coding section 702. The code vector CODE (k)(0)~CODE(k)(N−1) is a vector with a length of N. k is an index of the code vector and takes values ranging from 0 to 255. Long term prediction residual signal coding section 702 obtains a square error er between long term prediction residual signal p(n)~p(n+N−1) and code vector CODE(k)(0)~CODE(k)(N−1) using following equation (7).

$$er = \sum_{i=0}^{N-1} (p(n+i) - CODE^{(k)}(i))^2 \quad \text{Equation (7)}$$

Then, long term prediction residual signal coding section 702 determines a value of k that minimizes the square error er as long term prediction residual coded information.

Coded information multiplexing section 703 multiplexes the enhancement layer coded information input from long term prediction coefficient coding section 504 and the long term prediction residual coded information input from long term prediction residual signal coding section 702, and outputs the multiplexed information to enhancement layer decoding section 153 via the transmission channel.

Long term prediction residual signal decoding section 704 decodes the long term prediction residual coded information, and outputs decoded long term prediction residual signal pq(n)~pq(n+N−1) to adding section 705.

Adding section 705 adds long term prediction signal s(n)~s(n+N−1) input from long term prediction signal generating section 506 and decoded long term prediction residual signal pq(n)~pq(n+N−1) input from long term prediction residual signal decoding section 704, and outputs the result of the addition to long term prediction signal storage 502. As a result, long term prediction signal storage 502 updates the buffer using following equation (8).

$$\left.\begin{aligned} \hat{s}(i) &= s(i+N)(i = n-M-1, \cdots, n-N-1) \\ \hat{s}(i) &= s(i+N) + p, (i-N)(i = n-N, \cdots, n-1) \end{aligned}\right\} \quad \text{Equation (8)}$$

$$s(i) = \hat{s}(i)(i = n-M-1, \cdots, n-1)$$

The foregoing is explanations of the internal configuration of enhancement layer coding section 104 according to this Embodiment.

An internal configuration of enhancement layer decoding section 153 according to this Embodiment will be described below with reference to the block diagram in FIG. 8. In addition, in FIG. 8, structural elements common to FIG. 6 are assigned the same reference numerals as in FIG. 6 to omit descriptions.

Figure 8:
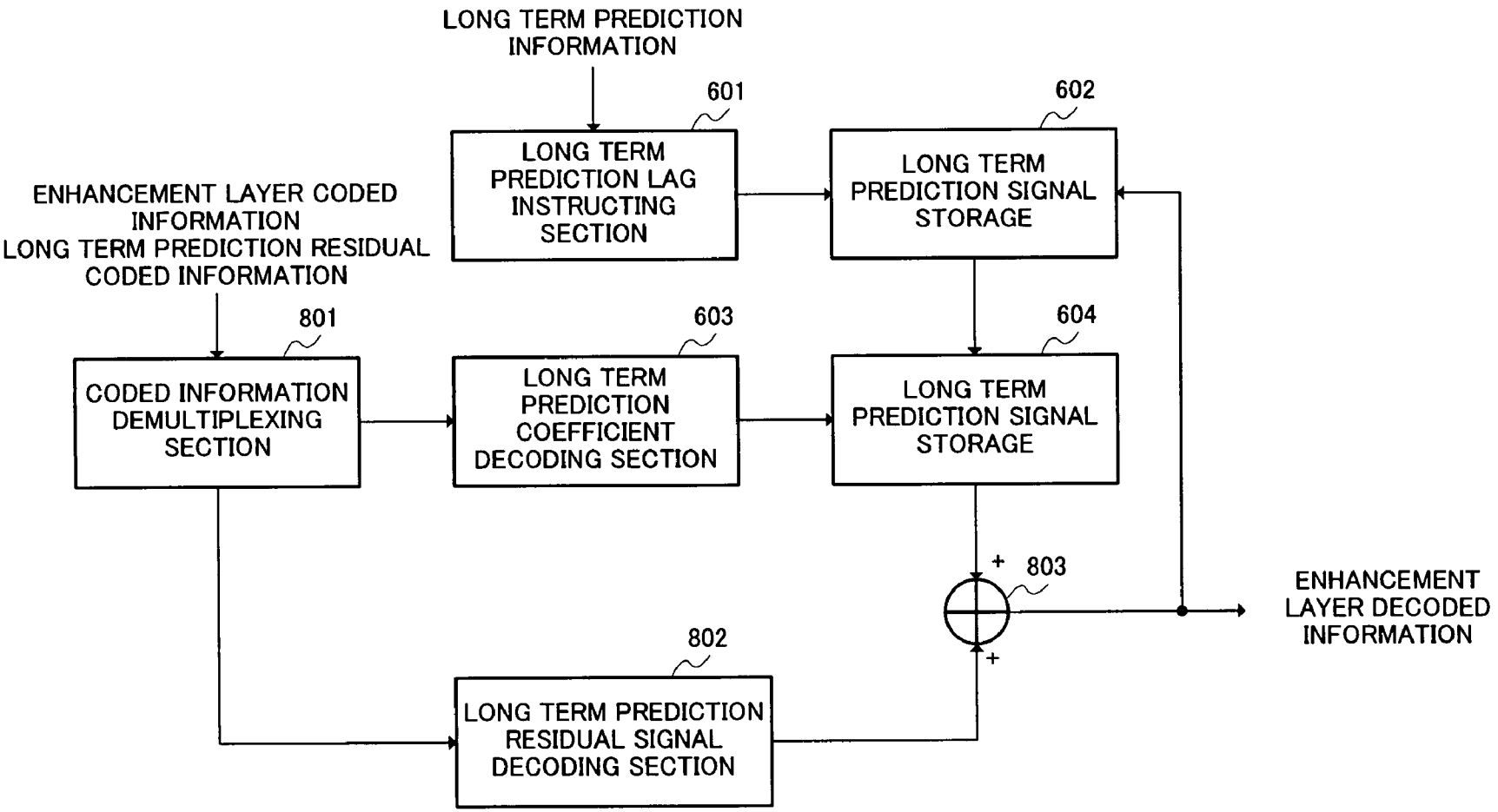
FIG. 8 is a block diagram illustrating an internal configuration of an enhancement layer decoding section according to the above Embodiment.

Compared with FIG. 6, enhancement layer decoding section 153 in FIG. 8 is further provided with coded information demultiplexing section 801, long term prediction residual signal decoding section 802 and adding section 803.

Coded information demultiplexing section 801 demultiplexes the multiplexed coded information received via the transmission channel into the enhancement layer coded information and long term prediction residual coded information, and outputs the enhancement layer coded information to long term prediction coefficient decoding section 603, and the long term prediction residual coded information to long term prediction residual signal decoding section 802.

Long term prediction residual signal decoding section 802 decodes the long term prediction residual coded information, obtains decoded long term prediction residual signal pq(n)~pq(n+N−1), and outputs the signal to adding section 803.

Adding section 803 adds long term prediction signal s(n)~s(n+N−1) input from long term prediction signal generating section 604 and decoded long term prediction residual signal pq(n)~pq(n+N−1) input from long term prediction residual signal decoding section 802, and outputs a result of the addition to long term prediction signal storage 602, while outputting the result as an enhancement layer decoded signal.

The foregoing is explanations of the internal configuration of enhancement layer decoding section 153 according to this Embodiment.

By thus coding and decoding the difference (long term prediction residual signal) between the residual signal and long term prediction signal, it is possible to obtain a decoded signal with higher quality than previously described in Embodiment 1.

In addition, a case has been described above in this Embodiment of coding a long term prediction residual signal by vector quantization. However, the present invention is not limited in coding method, and coding may be performed using shape-gain VQ, split VQ, transform VQ or multi-phase VQ, for example.

A case will be described below of performing coding by shape-gain VQ of 13 bits of 8 bits in shape and 5 bits in gain. In this case, two types of codebooks are provided, a shape codebook and gain codebook. The shape codebook is comprised of 256 types of shape code vectors, and shape code vector SCODE(k1)(0)~SCODE(k1)(N−1) is a vector with a length of N. k1 is an index of the shape code vector and takes values ranging from 0 to 255. The gain codebook is comprised of 32 types of gain codes, and gain code GCODE(k2) takes a scalar value. k2 is an index of the gain code and takes values ranging from 0 to 31. Long term prediction residual signal coding section 702 obtains the gain and shape vector shape(0)~shape(N−1) of long term prediction residual signal p(n)~p(n+N−1) using following equation (9), and further obtains a gain error gainer between the gain and gain code GCODE(k2) and a square error shapeer between shape vector shape(0)~shape(N−1) and shape code vector SCODE(k1)(0)~SCODE(k1)(N−1).

$$\text{gain} = \sqrt{\sum_{i=0}^{N-1} p(n+i)^2} \quad \text{Equation (9)}$$

$$\text{shape}(i) = \frac{p(n+i)}{\text{gain}}(i = 0, \ldots, N-1)$$

$$\text{gainer} = |gatn - GCODE^{(k2)}| \quad \text{Equation (10)}$$

$$shapeer = \sum_{i=0}^{N-1} (\text{shape}(i) - SCODE^{(k2)}(i))^2$$

Then, long term prediction residual signal coding section 702 obtains a value of k2 that minimizes the gain error gainer and a value of k1 that minimizes the square error shapper, and determines the obtained values as long term prediction residual coded information.

A case will be described below where coding is performed by split VQ of 8 bits. In this case, two types of codebooks are prepared, the first split codebook and second split codebook.

The first split codebook is comprised of 16 types of first split code vectors SPCODE(k3)(0)~SPCODE(k3)(N/2−1), second split codebook SPCODE(k4)(0)~SPCODE(k4)(N/2−1) is comprised of 16 types of second split code vectors, and each code vector has a length of N/2. k3 is an index of the first split code vector and takes values ranging from 0 to 15 k4 is an index of the second split code vector and takes values ranging from 0 to 15. Long term prediction residual signal coding section 702 divides long term prediction residual signal p(n)~p(n+N−1) into first split vector sp1(0)~sp1(N/2−1) and second split vector sp2(0)~sp2(N/2−1) using following equation (11), and obtains a square error splitter 1 between first split vector sp1(0)~sp1(N/2−1) and first split code vector SPCODE(k3)(0)~SPCODE(k3)(N/2−1), and a square error splitter 2 between second split vector sp2(0)~sp2(N/2−1) and second split codebook SPCODE(k4)(0)~SPCODE(k4)(N/2−1), using following equation (12).

$$sp_1(i) = p(n+1)(i = 0, \ldots, N/2-1) \quad \text{Equation (11)}$$
$$sp_2(i) = p(n+N/2+i)(i = 0, \ldots, N/2-1)$$

$$spliter_1 = \sum_{i=0}^{N/2-1} \left(sp_1(i) - SPCODE_1^{(k3)}(i)\right)^2 \quad \text{Equation (12)}$$
$$spliter_2 = \sum_{i=0}^{N/2-1} \left(sp_2(i) - SPCODE_2^{(k4)}(i)\right)^2$$

Then, long term prediction residual signal coding section 702 obtains the value of k3 that minimizes the square error splitter 1 and the value of k4 that minimizes the square error splitter 2, and determines the obtained values as long term prediction residual coded information.

A case will be described below where coding is performed by transform VQ of 8 bits using discrete Fourier transform. In this case, a transform codebook comprised of 256 types of transform code vector is prepared, and transform code vector TCODE(k5)(0)~TCODE(k5)(N/2−1) is a vector with a length of N/2. k5 is an index of the transform code vector and takes values ranging from 0 to 255. Long term prediction residual signal coding section 702 performs discrete Fourier transform of long term prediction residual signal p(n)~p(n+N−1) to obtain transform vector tp(0)~tp(N−1) using following equation (13), and obtains a square error transer between transform vector tp(0)~tp(N−1) and transform code vector TCODE(k5)(0)~TCODE(k5)(N/2−1) using following equation (14).

$$tp(\hat{i}) = \sum_{i=0}^{N-1} p(n+i)e^{-j\frac{2\pi\sigma i}{N}} \left(\hat{i} = 0, \ldots N-1\right) \quad \text{Equation (13)}$$

$$\text{transer} = \sum_{i=0}^{N-1} (tp(i) - TCODE^{(k3)}(i))^2 \quad \text{Equation (14)}$$

Then, long term prediction residual signal coding section 702 obtains a value of k5 that minimizes the square error transfer, and determines the obtained value as long term prediction residual coded information.

A case will be described below of performing coding by two-phase VQ of 13 bits of 5 bits for a first stage and 8 bits for a second stage. In this case, two types of codebooks are prepared, a first stage codebook and second stage codebook. The first stage codebook is comprised of 32 types of first stage code vectors PHCODE1(k6)(0)~PHCODE1(k6)(N−1), the second stage codebook is comprised of 256 types of second stage code vectors PHCODE2(k7)(0)~PHCODE2(k7)(N−1), and each code vector has a length of N/2.k6 is an index of the first stage code vector and takes values ranging from 0 to 31.

k7 is an index of the second stage code vector and takes values ranging from 0 to 255. Long term prediction residual signal coding section 702 obtains a square error phaseer 1 between long term prediction residual signal p(n)~p(n+N−1) and first stage code vector PHCODE1(k6)(0)~PHCODE1(k6)(N−1) using following equation (15), further obtains the value of k6 that minimizes the square error phaseer 1, and determines the value as Kmax.

$$phaseer_1 = \sum_{i=0}^{N-1} (tp(i) - TCODE^{(k3)}(i))^2 \quad \text{Equation (15)}$$

Then, long term prediction residual signal coding section 702 obtains error vector ep(0)~ep(N−1) using following equation (16), obtains a square error phaseer 2 between error vector ep(0)~ep(N−1) and second stage code vector PHCODE2(k7)(0)~PHCODE2(k7)(N−1) using following equation (17), further obtains a value of k7 that minimizes the square error phaseer 2, and determines the value and Kmax as long term prediction residual coded information.

$$ep(i) = p(n+1) - PHCODE_1^{(kmax)}(i) \quad (i = 0, \ldots, N-1) \quad \text{Equation (16)}$$

$$phaseer_2 = \sum_{i=0}^{N-1} \left(ep(i) - PHCODE_2^{(k3)}(i)\right)^2 \quad \text{Equation (17)}$$

Embodiment 3

Figure 9:
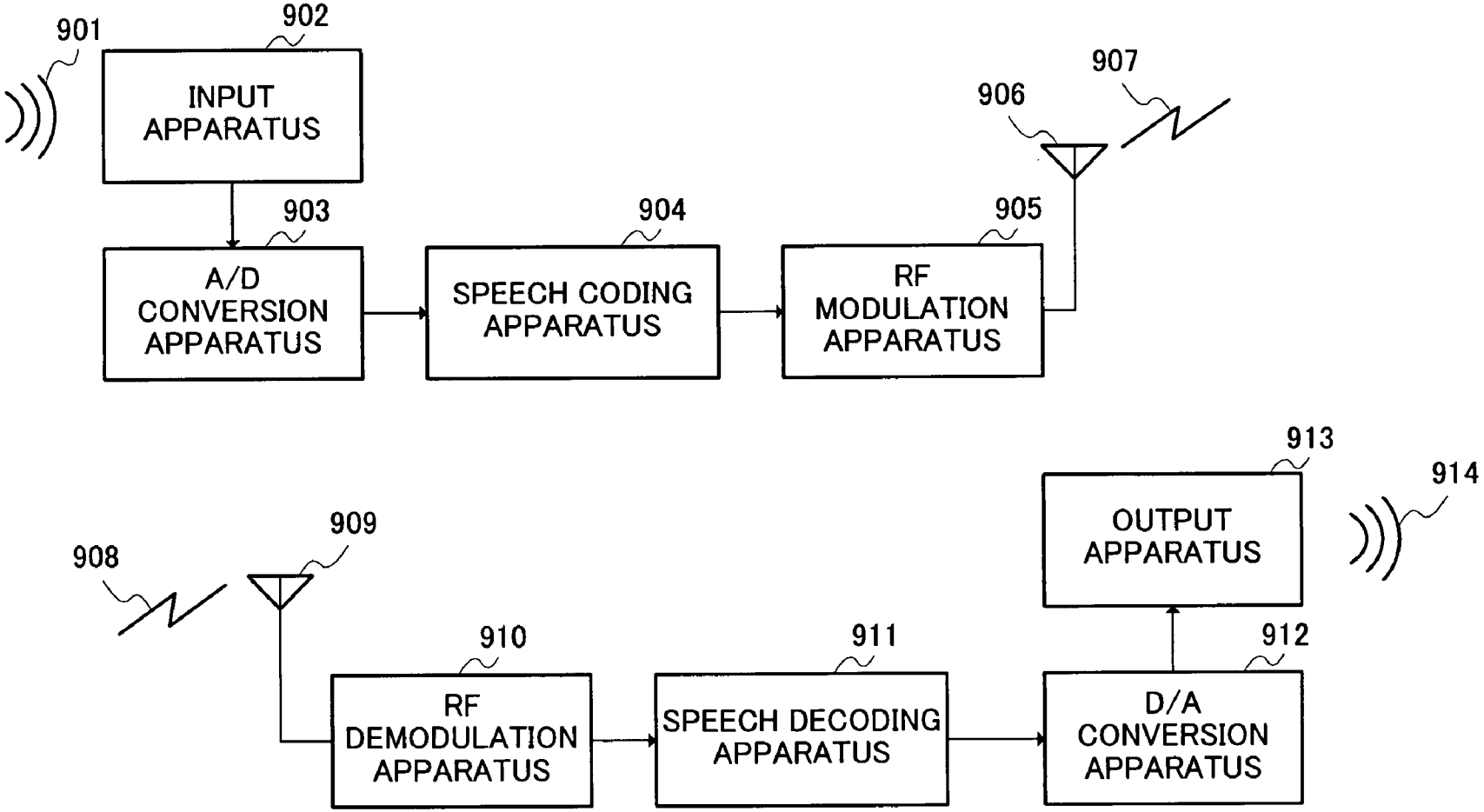
FIG. 9 is a block diagram illustrating configurations of a speech signal transmission apparatus and speech signal reception apparatus according to Embodiment 3 of the invention.

FIG. 9 is a block diagram illustrating configurations of a speech signal transmission apparatus and speech signal reception apparatus respectively having the speech coding apparatus and speech decoding apparatus described in Embodiments 1 and 2.

In FIG. 9, speech signal 901 is converted into an electric signal through input apparatus 902 and output to A/D conversion apparatus 903. A/D conversion apparatus 903 converts the (analog) signal output from input apparatus 902 into a digital signal and outputs the result to speech coding apparatus 904. Speech coding apparatus 904 is installed with speech coding apparatus 100 as shown in FIG. 1, encodes the digital speech signal output from A/D conversion apparatus 903, and outputs coded information to RF modulation apparatus 905. R/F modulation apparatus 905 converts the speech coded information output from speech coding apparatus 904 into a signal of propagation medium such as a radio signal to transmit the information, and outputs the signal to transmission antenna 906. Transmission antenna 906 transmits the output signal output from RF modulation apparatus 905 as a radio signal (RF signal). In addition, RF signal 907 in FIG. 9 represents a radio signal (RF signal) transmitted from transmission antenna 906. The configuration and operation of the speech signal transmission apparatus are as described above.

RF signal 908 is received by reception antenna 909 and then output to RF demodulation apparatus 910. In addition, RF signal 908 in FIG. 9 represents a radio signal received by reception antenna 909, which is the same as RF signal 907 if attenuation of the signal and/or multiplexing of noise does not occur on the propagation path.

RF demodulation apparatus 910 demodulates the speech coded information from the RF signal output from reception antenna 909 and outputs the result to speech decoding apparatus 911. Speech decoding apparatus 911 is installed with speech decoding apparatus 150 as shown in FIG. 1, decodes the speech signal from the speech coded information output from RF demodulation apparatus 910, and outputs the result to D/A conversion apparatus 912. D/A conversion apparatus 912 converts the digital speech signal output from speech decoding apparatus 911 into an analog electric signal and outputs the result to output apparatus 913.

Output apparatus 913 converts the electric signal into vibration of air and outputs the result as a sound signal to be heard by human ear. In addition, in the figure, reference numeral 914 denotes an output sound signal. The configuration and operation of the speech signal reception apparatus are as described above.

It is possible to obtain a decoded signal with high quality by providing a base station apparatus and communication terminal apparatus in a wireless communication system with the above-mentioned speech signal transmission apparatus and speech signal reception apparatus.

As described above, according to the present invention, it is possible to code and decode speech and sound signals with a wide bandwidth using less coded information, and reduce the computation amount. Further, by obtaining a long term prediction lag using the long term prediction information of the base layer, the coded information can be reduced. Furthermore, by decoding the base layer coded information, it is possible to obtain only a decoded signal of the base layer, and in the CELP type speech coding/decoding method, it is possible to implement the function of decoding speech and sound from part of the coded information (scalable coding).

This application is based on Japanese Patent Application No. 2003-125665 filed on Apr. 30, 2003, entire content of which is expressly incorporated by reference herein.

INDUSTRIAL APPLICABILITY

The present invention is suitable for use in a speech coding apparatus and speech decoding apparatus used in a communication system for coding and transmitting speech and/or sound signals.

The invention claimed is:

1. A speech coding apparatus comprising:

a base layer coder that codes an input signal and generates first coded information;

a base layer decoder that decodes the first coded information and generates a first decoded signal, while generating long term prediction information comprising information representing long term correlation of speech or sound;

an adder that obtains a residual signal representing a difference between the input signal and the first decoded signal; and an enhancement layer coder that calculates a long term prediction coefficient using long term prediction information and the residual signal, and codes the long term prediction coefficient and generates second coded information, wherein the enhancement layer coder comprises:

an obtainer that obtains a long term prediction lag of an enhancement layer based on long term prediction information;

a fetcher that fetches a long term prediction signal back by the long term prediction lag from a previous long term prediction signal sequence stored in a buffer;

a first calculator that calculates the long term prediction coefficient using the residual signal and the long term prediction signal;

a coder that codes the long term prediction coefficient and generates enhancement layer coded information;

a decoder that decodes enhancement layer coded information and generates a decoded long term prediction coefficient; and a second calculator that calculates a new long term prediction signal using the decoded long term prediction coefficient and the long term prediction signal, and updates the buffer using the new long term prediction signal.

2. The speech coding apparatus according to claim 1, wherein the enhancement layer coder further comprises:

a second obtainer that obtains a long term prediction residual signal representing a difference between the residual signal and the long term prediction signal;

a second coder that codes the long term prediction residual signal and generates long term prediction residual coded information;

a second decoder that decodes long term prediction residual coded information and calculates a decoded long term prediction residual signal; and a second adder that adds the new long term prediction signal and the decoded long term prediction residual signal, and updates the buffer using a result of the addition.

3. The speech coding apparatus according to claim 1, wherein the base layer decoder uses information specifying a fetching position where an adaptive excitation vector is fetched from an excitation vector signal sample, as long term prediction information.

4. A speech decoding apparatus that receives first coded information and second coded information from the speech coding apparatus according to claim 1, and decodes speech, said speech decoding apparatus comprising:

a base layer decoder that decodes first coded information to generate a first decoded signal, while generating long term prediction information comprising information representing long term correlation of speech or sound;

an enhancement layer decoder that decodes second coded information using the long term prediction information and generates a second decoded signal; and a second adder that adds the first decoded signal and the second decoded signal, and outputs a speech or sound signal as a result of the addition, wherein the enhancement layer decoder comprises:

an obtainer that obtains a long term prediction lag of an enhancement layer based on long term prediction information;

a fetcher that fetches a long term prediction signal back by the long term prediction lag from a previous long term prediction signal sequence stored in a buffer;

a decoder that decodes enhancement layer coded information and obtains a decoded long term prediction coefficient; and a calculator that calculates a long term prediction signal using the decoded long term prediction coefficient and the long term prediction signal, and updates the buffer using the long term prediction signal, wherein the enhancement layer decoder uses the long term prediction signal as an enhancement layer decoded signal.

5. The speech decoding apparatus according to claim 4, wherein the enhancement layer decoder further comprises:

a decoder that decodes long term prediction residual coded information and obtains a decoded long term prediction residual signal; and a third adder that adds the long term prediction signal and the decoded long term prediction residual signal, wherein the enhancement layer decoder uses a result of addition as an enhancement layer decoded signal.

6. The speech decoding apparatus according to claim 4, wherein the base layer decoder uses information specifying a fetching position where an adaptive excitation vector is fetched from an excitation vector signal sample, as long term prediction information.

* * * * *

UNITED STATES PATENT AND TRADEMARK OFFICE

CERTIFICATE OF CORRECTION

PATENT NO. : 7,299,174 B2
APPLICATION NO. : 10/554619
DATED : November 20, 2007
INVENTOR(S) : Kaoru Sato et al.

It is certified that error appears in the above-identified patent and that said Letters Patent is hereby corrected as shown below:

On the cover page, References Cited (56), of the printed patent, insert:

-- FOREIGN PATENT DOCUMENTS

| | | |
|---|---|---|
| 8-054900 | 02/27/96 | (JP) |
| 8-328595 | 12/13/96 | (JP) |
| 10-177399 | 06/30/98 | (JP) |
| 5-249999 | 09/28/93 | (JP) |
| 8-147000 | 06/07/96 | (JP) |
| 8-211895 | 08/20/96 | (JP) |
| 5-073099 | 03/26/93 | (JP) |
| 6-102900 | 04/15/94 | (JP) -- |

Signed and Sealed this

Twentieth Day of April, 2010

David J. Kappos

David J. Kappos
*Director of the United States Patent and Trademark Office*